US012227884B2

(12) United States Patent
Hwang

(10) Patent No.: US 12,227,884 B2
(45) Date of Patent: Feb. 18, 2025

(54) BREATHABLE FABRIC

(71) Applicant: A-SUNG CO., LTD., Daegu (KR)

(72) Inventor: Ki Hun Hwang, Daegu (KR)

(73) Assignee: A-SUNG CO., LTD., Daegu (KR)

( * ) Notice: Subject to any disclaimer, the term of this patent is extended or adjusted under 35 U.S.C. 154(b) by 7 days.

(21) Appl. No.: 18/306,042

(22) Filed: Apr. 24, 2023

(65) Prior Publication Data

US 2023/0340704 A1 Oct. 26, 2023

(30) Foreign Application Priority Data

Apr. 25, 2022 (KR) ..... 10-2022-0050958

(51) Int. Cl.
*D03D 13/00* (2006.01)
*D03D 15/00* (2021.01)

(52) U.S. Cl.
CPC .... *D03D 13/004* (2013.01); *D10B 2403/0114* (2013.01)

(58) Field of Classification Search
CPC ..... D03D 13/004; D03D 9/00; D03D 15/43; D03D 3/08; D10B 2403/0114
See application file for complete search history.

(56) References Cited

U.S. PATENT DOCUMENTS 10,844,525 B2 * 11/2020 Ohanians ..... D03D 15/217
2015/0167208 A1 * 6/2015 Bischoff ..... D03D 15/47 139/50
2019/0352807 A1 * 11/2019 Jhunjhunwala ..... D02G 3/02
2019/0352812 A1 * 11/2019 Jhunjhunwala ..... D03D 15/283
2020/0107599 A1 * 4/2020 Bologna ..... D03D 15/00
2020/0299872 A1 * 9/2020 Ohanians ..... D03D 13/004
2022/0064825 A1 * 3/2022 Cockerham ..... D03D 15/225
2022/0080701 A1 * 3/2022 Zulifqar ..... A41D 31/305
2023/0042529 A1 * 2/2023 Shiraishi ..... B32B 5/024
2023/0144350 A1 * 5/2023 Wang ..... D03D 15/47 442/182

FOREIGN PATENT DOCUMENTS

CN 203320224 U * 12/2013 ..... D03D 15/00
CN 102573996 B 10/2014
CN 203977032 U * 12/2014 ..... D03D 15/00
CN 204039629 U * 12/2014 ..... D03D 15/08
CN 204702882 U 10/2015
CN 107780018 A 3/2018
(Continued)

OTHER PUBLICATIONS

Extended European Search Report issued in European Application No. 23168405.1, mailed on Sep. 15, 2023 (7 pages).

*Primary Examiner* — Robert H Muromoto, Jr.
(74) *Attorney, Agent, or Firm* — Osha Bergman Watanabe & Burton LLP

(57) ABSTRACT

Disclosed is a breathable fabric. In the disclosed breathable fabric, a first one side warp and a second one side warp are arranged above a first one side weft, a second one side weft, and a third one side weft and arranged below a first other side weft, a second other side weft, and a third other side weft, and a third one side warp is arranged below the third one side weft, the first other side weft, and the second other side weft and is arranged above the first one side weft, the second one side weft, and the third other side weft.

7 Claims, 6 Drawing Sheets

(56) References Cited

FOREIGN PATENT DOCUMENTS

| | | | | | |
|---|---|---|---|---|---|
| JP | 2022031822 | A | | 2/2022 | |
| KR | 0184711 | B1 | * | 5/1999 | ..... B60R 21/235 |
| KR | 100959509 | B1 | | 5/2010 | |
| KR | 101582550 | B1 | | 1/2016 | |
| KR | 101788692 | B1 | | 10/2017 | |
| KR | 102332697 | B1 | | 12/2021 | |

* cited by examiner

BREATHABLE FABRIC

CROSS-REFERENCE TO RELATED APPLICATION

This application claims priority to and the benefit of Korean Patent Application No. 10-2022-0050958 filed on Apr. 25, 2022, the disclosure of which is incorporated herein by reference in its entirety.

BACKGROUND

1. Field of the Invention

The present disclosure relates to a breathable fabric, and more particularly, to a breathable fabric in which a weft and a warp of the fabric each include a plurality of strands of yarn, some yarn of the plurality of strands of yarn constituting the weft is convexly woven on one side of the fabric while the rest of the yarn is convexly woven on the other side of the fabric, some yarn of the plurality of strands of yarn constituting the warp is convexly woven on the other side of the fabric while the rest of the yarn is convexly woven on the one side of the fabric, and thus the fabric may be woven to have a three-dimensional effect in a desired shape, the weft and warp are woven in a lattice shape to form a ventilation hole, and thus the fabric can be used as a fabric that requires breathability, and alignment yarn is woven on both outermost sides of the weft and the warp including the plurality of strands of yarn, a state in which the weft and the warp are bundled is maintained, and thus the durability of the fabric increases and the shape of the ventilation hole is maintained.

2. Discussion of Related Art

In general, fabrics are woven by alternating warps and wefts, and fabrics in which ventilation holes are formed according to the purpose and usage are also provided.

A review of the related art related to a breathable fabric shows a "Method of manufacturing highly breathable fabric" disclosed in Korean Patent Registration No. 10-0959509 (Patent Document 1), an "Upper for breathable shoe using jacquard loom and method of manufacturing same" disclosed in Korean Patent Registration No. 10-1582550 (Patent Document 2), and a "Method of manufacturing breathable fabric" disclosed in Korean Patent Registration No. 10-1788692 (Patent Document 3).

Patent Document 1 relates to a method of manufacturing a highly breathable fabric, and more particularly, a method of manufacturing a highly breathable fabric, in which dissolvent yarn is inserted between a weft and a warp while the weft and the warp are spaced apart from each other during weaving, the woven fabric is treated using a scouring solution during scouring and the dissolvent yarn formed between the weft and the warp is thus melted to form a lattice-shaped air hole in the fabric or the woven fabric is treated using water before or after being treated using the scouring solution during the scouring and the dissolvent yarn formed between the weft and the warp is thus melted to form a lattice-shaped air hole in the fabric, and thus air smoothly circulates between an inside and an outside of the fabric, moisture is easily dried, washing power is excellent, and when the fabric is used as an outer skin, the lattice-shaped air hole exhibits a color matching effect that contrasts with a color of a lining.

Patent Document 2 relates to an upper fabric for a breathable shoe and a method of manufacturing the same, in which the upper fabric for the breathable shoe is woven as a warp portion in a longitudinal direction and a weft portion in a width direction cross each other at right angles, a fine longitudinal interval is formed in the longitudinal direction between the warp portions in the longitudinal direction, a fine transverse interval is formed in the width direction between the weft portions in the width direction, a weaving unit is formed at a point at which the warp portion and the weft portion cross each other, and a ventilation hole is formed at a point at which the longitudinal interval in the longitudinal direction and the transverse interval in the width direction cross each other.

In Patent Document 3, during weaving, in a state in which a warp is left empty at regular intervals, a dissolvent yarn is inserted into a weft at regular intervals, and the dissolvent yarn is then removed. Thus, cost can be reduced by reducing the dissolvent yarn and a solvent, operation harmfulness and environmental pollution can be reduced due to the reduction in the solvent, and work efficiency can be improved and cost can be reduced by reducing or simplifying work processes.

The above technical configurations are background art for helping with understanding of the present disclosure, and are not necessarily related art widely known in the technical field to which the present disclosure pertains.

SUMMARY OF THE INVENTION

In the case of a fabric having a ventilation hole according to the related art, dissolvent yarn is positioned in the warp and weft at regular intervals, the dissolvent yarn is then dissolved through a post-processing process, and the ventilation hole is formed at an intersection between the warp and the weft at which the dissolvent yarn is positioned. Thus, since a process of removing the dissolvent yarn through a separate post-processing process is required, not only is the processing cumbersome but the environment is also polluted due to use of a solvent in a dissolving process.

Further, in the case of the fabric having a ventilation hole according to the related art, the fabric is woven so that minute gaps are formed at the warp and the weft at regular intervals, and thus the ventilation hole is formed at a point at which the minute gaps intersect each other. However, in the case of the fabric, the tissue density of the minute gaps is sparse, and although an effect of ventilation may thus be expected, the durability of the sparsely woven portion is reduced.

Therefore, this problem needs to be solved.

The present disclosure is directed to providing a breathable fabric in which the weft and warp of the fabric are each provided as a plurality of strands of yarn, some of the plurality of strands of yarn constituting the weft are convexly woven on one side of the fabric and the others are convexly woven on the other side of the fabric, some of the plurality of strands of yarn constituting the warp are convexly woven on other side of the fabric and the others are convexly woven on the one side of the fabric, and thus the fabric is woven to have a three-dimensional effect in a desired shape, thereby implementing excellent aesthetics.

The present disclosure is also directed to providing a breathable fabric that may be utilized as a fabric requiring breathability by weaving the weft and the warp in a lattice shape to form a ventilation hole.

The present disclosure is also directed to providing a breathable fabric in which, as alignment yarn is woven on outermost sides of each of the weft and the warp provided as a plurality of strands of yarn, a state in which each strand of the weft and each strand of the weft are bundled is maintained, and thus the durability of the fabric increases and the shape of the ventilation hole is maintained.

The present disclosure is also directed to providing a breathable fabric which does not require a separate post-processing process as the warp and the weft are woven in a predetermined pattern so that the ventilation hole is formed at a set position of the fabric.

A breathable fabric according to the present disclosure includes a warp (wp) of which a plurality of strands are spaced a uniform or non-uniform distance from each other and arranged in a transverse direction, and a weft (wf) of which a plurality of strands are spaced a uniform or non-uniform distance from each other, are arranged in a longitudinal direction, and are woven in an inclined direction with respect to the warp to form a lattice shape.

The warp may be woven to alternately and vertically cross one strand of the weft and may be arranged over the same upper side or lower side of two or more strands of the weft at a specific position, and the weft may be arranged over the same upper side or lower side of two or more strands of the warp at a set position.

In the warp, a one side warp and an other side warp may be alternately arranged, and in the weft, a one side weft and an other side weft may be alternately arranged.

The one side warp may include a first one side warp and a second one side warp, the other side warp may include a first other side warp and a second other side warp, the one side weft may include a first one side weft and a second one side weft, and the other side weft may include a first other side weft and a second other side weft.

At least one of the first one side warp and the second one side warp may be arranged above the first one side weft and the second one side weft and below the first other side weft and the second other side weft in an area in which one strand of the warp and one strand of the weft vertically cross each other.

The one side warp may include a third one side warp disposed between the first one side warp and the second one side warp, the one side weft may include a third one side weft disposed between the first one side weft and the second one side weft, and the other side weft may include a third other side weft disposed between the first other side weft and the second other side weft.

The first one side warp and the second one side warp may be arranged above the third one side weft and arranged below the third other side weft, and the third one side warp may be disposed above the first one side weft and the second one side weft, disposed below the third one side weft, and disposed above the third other side weft.

The other side warp may include a third other side warp disposed between the first other side warp and the second other side warp.

The first other side warp and the second other side warp may be arranged below the first one side weft, the second one side weft, and the third one side weft and arranged above the first other side weft, the second other side weft, and the third other side weft.

The third other side warp may be disposed below the first one side weft, the second one side weft, and the third other side weft and disposed above the third one side weft, the first other side weft, and the second other side weft.

The one side warp may include a first one side alignment warp disposed along an outside of the first one side warp and a second one side alignment warp disposed along an outside of the second one side warp.

The other side warp may include a first other side alignment warp disposed along an outside of the first other side warp and a second other side alignment warp disposed along an outside of the second other side warp.

The first one side alignment warp and the second one side alignment warp may be symmetrical to the first one side warp, arranged below the one side weft, arranged above the other side weft, and thus guide the one side weft and the other side weft such that the one side weft and the other side weft are in close contact with the first one side warp.

The first other side alignment warp and the second other side alignment warp may be symmetrical to the first other side warp, arranged above the one side weft, arranged below the other side weft, and thus guide the one side weft and the other side weft such that the one side weft and the other side weft are in close contact with the first other side warp.

A plurality of threads of yarn constituting the warp may have the same linear mass density or different linear mass densities, and a plurality of threads of yarn constituting the weft may have the same linear mass density or different linear mass densities.

The plurality of threads of yarn constituting the warp may be made of the same material or different materials, and the plurality of threads of yarn constituting the weft may be made of the same material or different materials.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
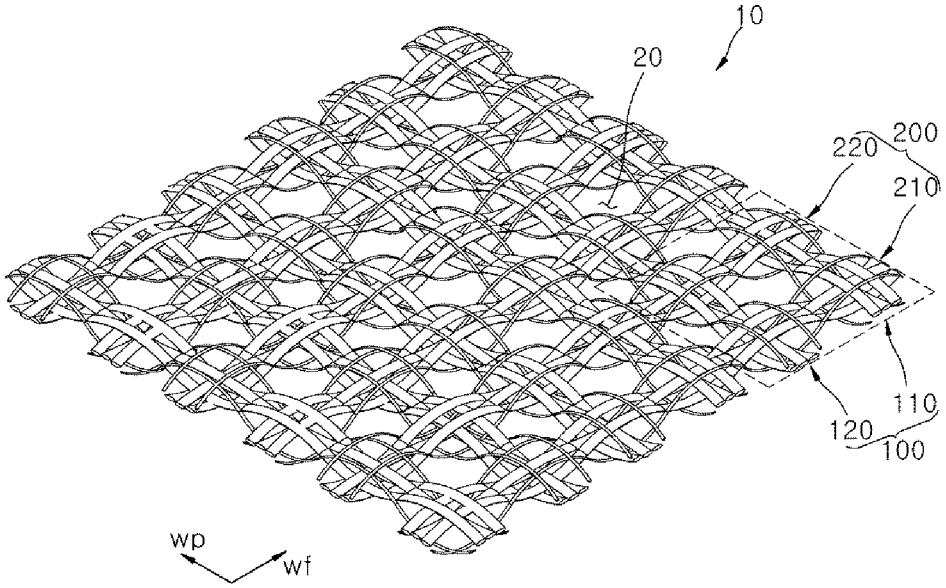
FIG. 1 is a perspective view of a breathable fabric according to an embodiment of the present disclosure.

Hereinafter, a breathable fabric according to an embodiment of the present disclosure will be described with reference to the accompanying drawings. In this process, the thickness of lines or the size of components illustrated in the drawings may be exaggerated for clarity and convenience of description. Further, terms described below are terms defined in consideration of functions in the present disclosure and may change according to the intention or custom of a user or an operator. Therefore, definitions of these terms should be made based on the content throughout the present specification.

Figure 2:
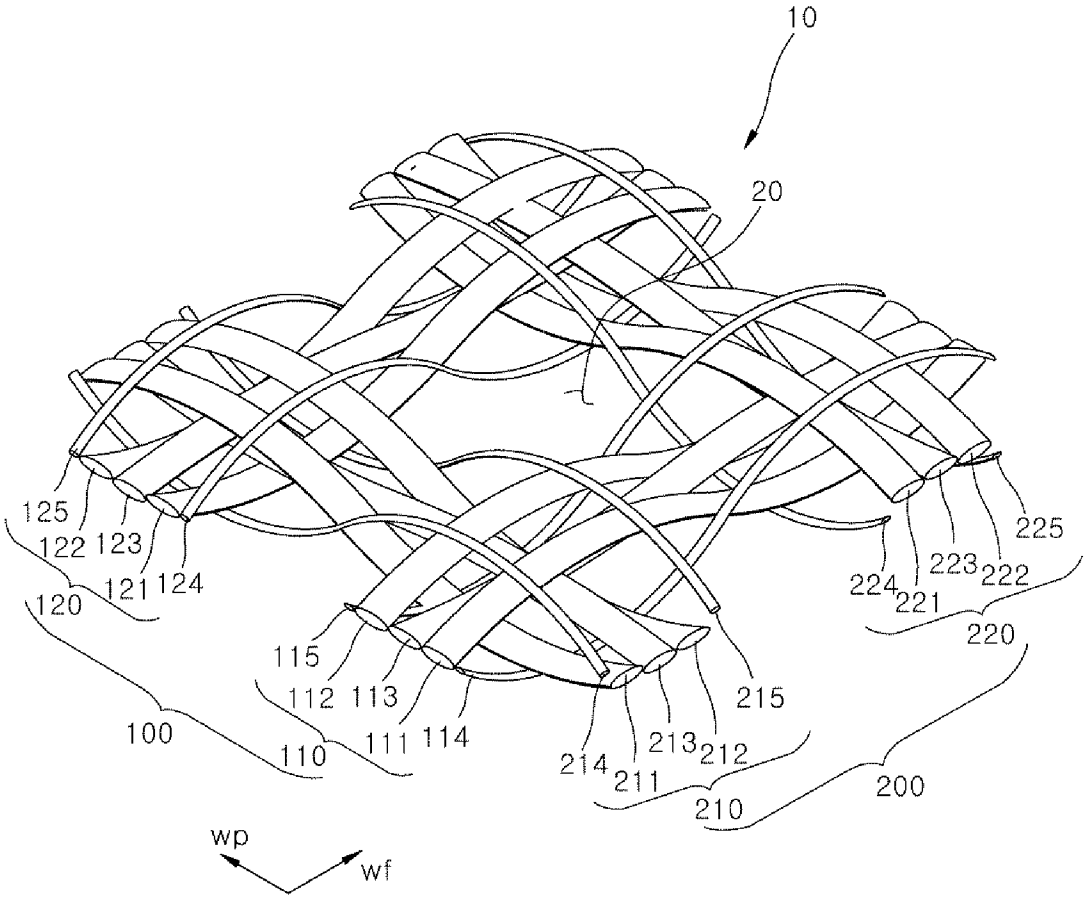
FIG. 2 is an enlarged perspective view of the breathable fabric according to the embodiment of the present disclosure.

FIG. 1 is a perspective view of a breathable fabric according to an embodiment of the present disclosure, and FIG. 2 is an enlarged perspective view of the breathable fabric according to the embodiment of the present disclosure.

Figure 3:
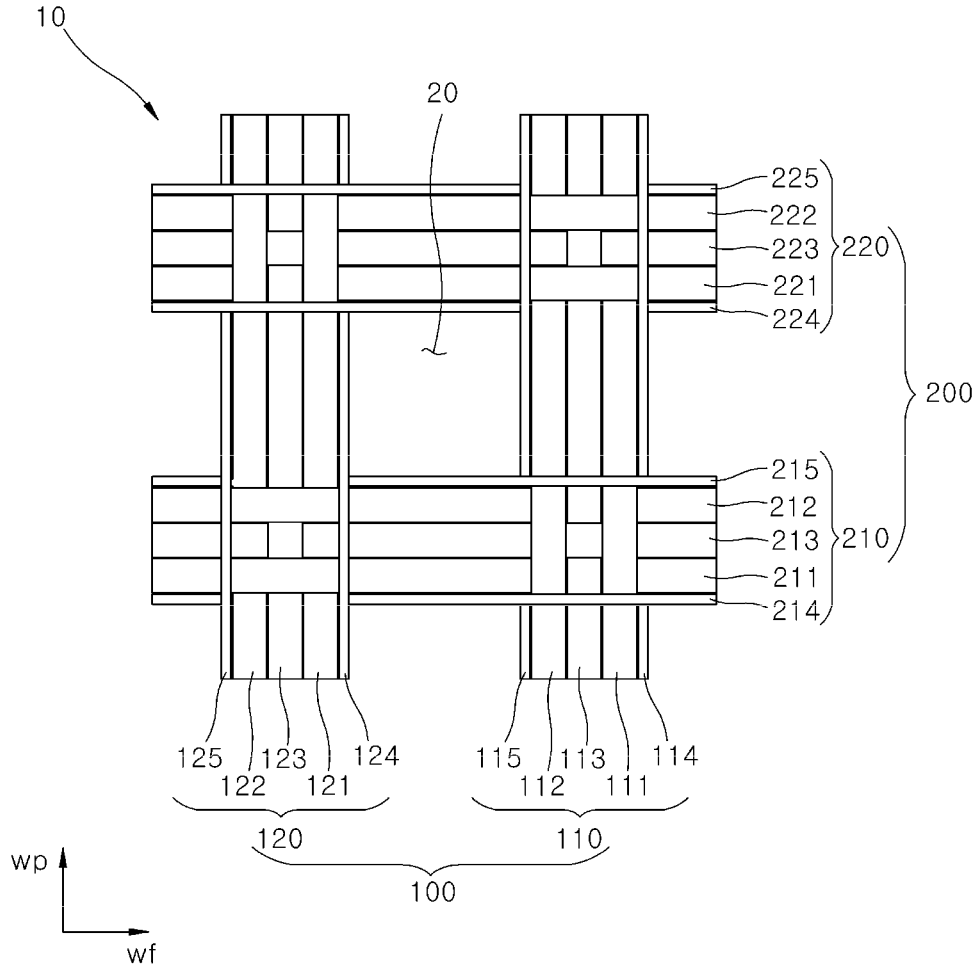
FIG. 3 is a plan view of the breathable fabric according to the embodiment of the present disclosure.
Figure 4:
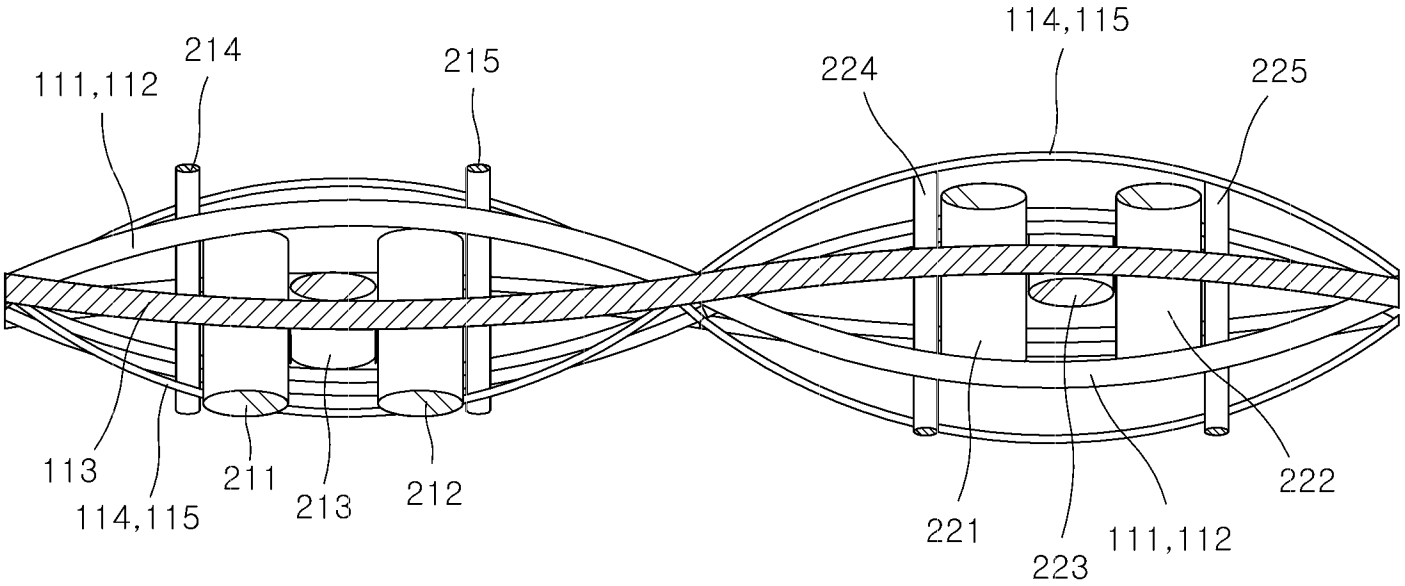
FIG. 4 is a cross-sectional view of the breathable fabric according to the embodiment of the present disclosure.

FIG. 3 is a plan view of the breathable fabric according to the embodiment of the present disclosure, and FIG. 4 is a cross-sectional view of the breathable fabric according to the embodiment of the present disclosure.

Referring to FIGS. 1 to 4, a breathable fabric 10 according to an embodiment of the present disclosure is formed by weaving a plurality of strands of a warp wp and 100 and a plurality of strands of a weft wf and 200 in a lattice shape. That is, the warp 100 and the weft 200 are arranged perpendicular or oblique to each other.

In particular, the warp 100 is arranged in a transverse direction with the plurality of strands thereof spaced apart from each other at regular or irregular intervals, and the weft 200 is arranged in a longitudinal direction with the plurality of strands thereof spaced apart from each other at regular or irregular intervals.

Further, the breathable fabric 10 is formed by weaving the strands of the warp 100 and the strands of the weft 200 so that the strands of the warp 100 and the strands of the weft 200 alternately and vertically cross each other with the plurality of strands of warp 100 and the plurality of strands of weft 200 arranged in directions oblique to each other.

In this case, the plurality of strands of the warp 100 are arranged apart from each other at a set interval in a transverse direction, the plurality of strands of the weft 200 are arranged apart from each other at a set interval in the longitudinal direction, the warp 100 and the weft 200 are woven together, and thus the woven breathable fabric 10 forms a ventilation hole 20 having a set size.

In addition, in the warp 100, a one side warp 110 and an other side warp 120 are alternately arranged, and in the weft 200, a one side weft 210 and an other side weft 220 are alternately arranged.

In this case, in one direction, the one side warp 110 and the other side warp 120 are sequentially and alternately arranged. In addition, in the one direction, the one side weft 210 and the other side weft 220 are sequentially and alternately arranged.

Further, the one side warp 110 and the other side weft 220 have the same shape, and the other side warp 120 and the one side weft 210 have the same shape.

In detail, the one side warp 110 includes a first one side warp 111, a second one side warp 112, and a third one side warp 113.

In detail, the other side warp 120 includes a first other side warp 121, a second other side warp 122, and a third other side warp 123.

Further, the one side weft 210 includes a first one side weft 211, a second one side weft 212, and a third one side weft 213.

In addition, the other side weft 220 includes a first other side weft 221, a second other side weft 222, and a third other side weft 223.

Further, the first one side warp 111 and the second one side warp 112 are woven along the same trajectory while forming a water wave. That is, the first one side warp 111 and the second one side warp 112 are arranged above the first one side weft 211 and the second one side weft 212 and are then arranged below the first other side weft 221 and the second other side weft 222.

The first other side warp 121 and the second other side warp 122 are woven while forming a water wave symmetrical to the first one side warp 111. That is, the first other side warp 121 and the second other side warp 122 are arranged below the first one side weft 211 and the second one side weft 212 and are then arranged above the first other side weft 221 and the second other side weft 222.

Further, the first one side weft 211 and the second one side weft 212 are woven along the same trajectory while forming a water wave. That is, the first one side weft 211 and the second one side weft 212 are arranged below the first one side warp 111 and the second one side warp 112 and are then arranged above the first other side warp 121 and the second other side warp 122.

The first other side weft 221 and the second other side weft 222 are woven while forming a water wave symmetrical to the first one side weft 211. That is, the first other side weft 221 and the second other side weft 222 are arranged above the first one side warp 111 and the second one side warp 112 and are then arranged below the first other side warp 121 and the second other side warp 122.

Thus, in the breathable fabric 10, the first one side warp 111 and the second one side warp 112 woven on the first one side weft 211 and the second one side weft 212 are arranged side by side to protrude to one side surface (front side surface). In addition, in the breathable fabric 10, the first other side warp 121 and the second other side warp 122 woven on the first other side weft 221 and the second other side weft 222 are arranged side by side to protrude to the one side surface.

Further, in the breathable fabric 10, the first one side weft 211 and the second one side weft 212 woven on the first other side warp 121 and the second other side warp 122 are arranged side by side to protrude to the one side surface (front side surface). In addition, in the breathable fabric 10, the first other side weft 221 and the second other side weft 222 woven on the first one side warp 111 and the second one side warp 112 are arranged side by side to protrude to the one side surface.

Likewise, in the breathable fabric 10, the first other side warp 121, the second other side warp 122, the first one side warp 111, and the second one side warp 112 are arranged side by side to protrude in a diagonal direction with respect to the ventilation hole 20 on the other side surface (rear side surface). Further, in the breathable fabric 10, the first one side weft 211, the second one side weft 212, the first other side weft 221, and the second other side weft 222 are arranged side by side to protrude in the diagonal direction with respect to the ventilation hole 20 on the other side surface.

Thus, in the breathable fabric 10, at the same position, the first one side warp 111 and the second one side warp 112 are formed to protrude to the one side surface, and the first one side weft 211 and the second one side weft 212 are formed to protrude to the other side surface.

Thus, in the breathable fabric 10, at the same position, the first one side weft 211 and the second one side weft 212 are formed to protrude to the one side surface, and the first other side warp 121 and the second other side warp 122 are formed to protrude to the other side surface.

Further, in the breathable fabric 10, at the same position, the first other side weft 221 and the second other side weft 222 are formed to protrude to the one side surface, and the first one side warp 111 and the second one side warp 112 are formed to protrude to the other side surface.

Thus, in the breathable fabric 10, at the same position, the first other side warp 121 and the second other side warp 122 are formed to protrude to the one side surface, and the first other side weft 221 and the second other side weft 222 are formed to protrude to the other side surface.

As a result, the breathable fabric 10 is woven such that the warp 100 and the weft 200 protrude in a predetermined pattern on both sides, thereby increasing aesthetics or touch through a three-dimensional effect.

In this case, at the same position, a state in which the first one side warp 111 and the second one side warp 112 protrude toward the one side surface may be maintained, and a state in which the first one side weft 211 and the second one side weft 212 protrude to the other side surface may be maintained.

Further, at the same position, a state in which the first one side weft 211 and the second one side weft 212 protrude toward the one side surface may be maintained, and a state in which the first other side warp 121 and the second other side warp 122 protrude to the other side surface may be maintained.

Further, at the same position, a state in which the first other side weft 221 and the second other side weft 222 protrude toward the one side surface may be maintained, and a state in which the first one side warp 111 and the second one side warp 112 protrude to the other side surface may be maintained.

In addition, at the same position, a state in which the first other side warp 121 and the second other side warp 122 protrude toward the one side surface may be maintained, and a state in which the first other side weft 221 and the second other side weft 222 protrude to the other side surface may be maintained.

To this end, the third one side warp 113, the third other side warp 123, the third one side weft 213, and the third other side weft 223 are provided.

The third one side warp 113 is disposed between the first one side warp 111 and the second one side warp 112, is arranged below the third one side weft 213, and is arranged above the first one side weft 211 and the second one side weft 212 arranged at the same height. Thereafter, the third one side warp 113 is arranged below the first other side weft 221 and the second other side weft 222 arranged at the same height and is arranged above the third other side weft 223.

Of course, the third one side warp 113 may be disposed outside the first one side warp 111 or outside the second one side warp 112. However, the third one side warp 113 is disposed between the first one side warp 111 and the second one side warp 112 in order to improve the three-dimensional effect by spacing the first one side warp 111 and the second one side warp 112 apart from each other.

Further, the third other side warp 123 is disposed between the first other side warp 121 and the second other side warp 122, is arranged below the first one side weft 211 and the second one side weft 212 arranged at the same height, and is arranged below the third one side weft 213. Thereafter, the third other side warp 123 is arranged below the third other side weft 223 and is arranged above the first other side weft 221 and the second other side weft 222 arranged at the same height.

Of course, the third other side warp 123 may be disposed outside the first other side warp 121 or outside the second other side warp 122. However, the third other side warp 123 is disposed between the first other side warp 121 and the second other side warp 122 in order to improve the three-dimensional effect by spacing the first other side warp 121 and the second other side warp 122 apart from each other.

Meanwhile, the third one side weft 213 is disposed between the first one side weft 211 and the second one side weft 212, is arranged below the first one side warp 111 and the second one side warp 112 arranged at the same height, and is arranged above the third one side warp 113. Thereafter, the third one side weft 213 is arranged below the third other side warp 123 and is arranged above the first other side warp 121 and the second other side warp 122 arranged at the same height.

Of course, the third one side weft 213 may be disposed outside the first one side weft 211 or outside the second one side weft 212. However, the third one side weft 213 is disposed between the first one side weft 211 and the second one side weft 212 in order to improve the three-dimensional effect by spacing the first one side weft 211 and the second one side weft 212 apart from each other.

Further, the third other side weft 223 is disposed between the first other side weft 221 and the second other side weft 222, is arranged below the third one side weft 213, and is arranged above the first one side warp 111 and the second one side warp 112 arranged at the same height. Thereafter, the third other side weft 223 is arranged below the first other side warp 121 and the second other side warp 122 arranged at the same height and is arranged above the third other side warp 123.

Of course, the third other side weft 223 may be disposed outside the first other side weft 221 or outside the second other side weft 222. However, the third other side weft 223 is disposed between the first other side weft 221 and the second other side weft 222 in order to improve the three-dimensional effect by spacing the first other side weft 221 and the second other side weft 222 apart from each other.

In other words, the third one side warp 113 is arranged between the first one side weft 211 and the second one side weft 212 that are convex in a direction of the other side surface of the breathable fabric 10 and is arranged between the first one side warp 111 and the second one side warp 112 that are convex in a direction of the one side surface of the breathable fabric 10. Thereafter, the third one side warp 113 is arranged between the first other side weft 221 and the second other side weft 222 that are convex in the direction of the one side surface of the breathable fabric 10 and is arranged between the first one side warp 111 and the second one side warp 112 that are convex in the direction of the other side surface of the breathable fabric 10.

The third other side warp 123 is arranged between the first one side weft 211 and the second one side weft 212 that are convex in the direction of the one side surface of the breathable fabric 10 and is arranged between the first other side warp 121 and the second other side warp 122 that are convex in the direction of the other side surface of the breathable fabric 10. Thereafter, the third other side warp 123 is arranged between the first other side warp 121 and the second other side warp 122 that are convex in the direction of the one side surface of the breathable fabric 10 and is arranged between the first other side weft 221 and the second other side weft 222 that are convex in the direction of the other side surface of the breathable fabric 10.

The third one side weft 213 is arranged between the first one side warp 111 and the second one side warp 112 that are convex in the direction of the one side surface of the breathable fabric 10 and is arranged between the first one side weft 211 and the second one side weft 212 that are convex in the direction of the other side surface of the breathable fabric 10. Thereafter, the third one side warp 213 is arranged between the first one side weft 211 and the second one side weft 212 that are convex in the direction of the one side surface of the breathable fabric 10 and is arranged between the first other side warp 121 and the second other side warp 122 that are convex in the direction of the other side surface of the breathable fabric 10.

The third other side weft 223 is arranged between the first other side warp 121 and the second other side warp 122 that are convex in the direction of the one side surface of the breathable fabric 10 and is arranged between the first other side weft 221 and the second other side weft 222 that are convex in the direction of the other side surface of the breathable fabric 10.

Meanwhile, the first one side warp 111, the second one side warp 112, and the third one side warp 113 constituting the one side warp 110 may be arranged side by side, contact portions therebetween may tightly adhere to each other, and thus gaps therebetween may be minimized.

Further, the first other side warp 121, the second other side warp 122, and the third other side warp 123 constituting the other side warp 120 may be arranged side by side, contact portions therebetween may tightly adhere to each other, and thus gaps therebetween may be minimized.

Likewise, the first one side weft 211, the second one side weft 212, and the third one side weft 213 constituting the one side weft 210 may be arranged side by side, contact portions therebetween may tightly adhere to each other, and thus gaps therebetween may be minimized.

In addition, the first other side weft 221, the second other side weft 222, and the third other side weft 223 constituting the other side weft 220 may be arranged side by side, contact portions therebetween may tightly adhere to each other, and thus gaps therebetween may be minimized.

To this end, the one side warp 110 includes a first one side alignment warp 114 and a second one side alignment warp 115, and the other side warp 120 includes a first other side alignment warp 124 and a second other side alignment warp 125.

The one side weft 210 includes a first one side alignment weft 214 and a second one side alignment weft 215, and the other side weft 220 includes a first other side alignment weft 224 and a second other side alignment weft 225.

In detail, the first one side alignment warp 114 is arranged along an outer side of the first one side warp 111, and the second one side alignment warp 115 is arranged along an outer side of the second one side warp 112. That is, the first one side warp 111, the third one side warp 113, and the second one side warp 112 are sequentially arranged between the first one side alignment warp 114 and the second one side alignment warp 115 and maintain an aligned state.

Likewise, the first other side alignment warp 124 is arranged along an outer side of the first other side warp 121, and the second other side alignment warp 125 is arranged along an outer side of the second other side warp 122. That is, the first other side warp 121, the third other side warp 123, and the second other side warp 122 are sequentially arranged between the first other side alignment warp 124 and the second other side alignment warp 125 and maintain an aligned state.

Further, the first one side alignment weft 214 is arranged along an outer side of the first one side weft 211, and the second one side alignment warp 215 is arranged along an outer side of the second one side weft 212. That is, the first one side weft 211, the third one side warp weft 213, and the second one side weft 212 are sequentially arranged between the first one side alignment weft 214 and the second one side alignment weft 215 and maintain an aligned state.

Likewise, the first other side alignment weft 224 is arranged along an outer side of the first other side weft 221, and the second other side alignment weft 225 is arranged along an outer side of the second other side weft 222. That is, the first other side weft 221, the third other side weft 223, and the second other side weft 222 are sequentially arranged between the first other side alignment weft 224 and the second other side alignment weft 225 and maintain an aligned state.

In more detail, the first one side alignment warp 114 has a water wave shape symmetrical to the first one side warp 111, is arranged in contact with the lower side of the first one side weft 211 and the second one side weft 212, and thus fixedly presses the one side weft 210 toward the corresponding first one side warp 111, that is, in the direction of the one side surface of the breathable fabric 10.

Thereafter, the first one side alignment warp 114 is arranged in contact with the upper side of the first other side weft 221 and the second other side weft 222 and thus fixedly presses the other side weft 220 toward the corresponding first one side warp 111, that is, in the direction of the other side surface of the breathable fabric 10.

Further, the second one side alignment warp 115 is arranged along the same trajectory as the first one side alignment warp 114.

Thereafter, the first other side alignment warp 124 is arranged in contact with the upper side of the first one side weft 211 and the second one side weft 212 and thus fixedly presses the one side weft 210 toward the corresponding first other side warp 121, that is, in the direction of the other side surface of the breathable fabric 10.

Thereafter, the first other side alignment warp 124 is arranged in contact with the lower side of the first other side weft 221 and the second other side weft 222 and thus fixedly presses the other side weft 220 toward the corresponding first other side warp 121, that is, in the direction of the one side surface of the breathable fabric 10.

The second other side alignment warp 125 is arranged along the same trajectory as the first other side alignment warp 124.

Further, the first one side alignment weft 214 has a water wave shape symmetrical to the first one side weft 211, is arranged in contact with the upper side of the first one side warp 111 and the second one side warp 112, and thus fixedly presses the one side warp 110 toward the corresponding first one side weft 211, that is, in the direction of the other side surface of the breathable fabric 10.

Thereafter, the first one side alignment weft 214 is arranged in contact with the lower side of the first other side warp 121 and the second other side warp 122 and thus fixedly presses the other side warp 120 toward the corresponding first other side weft 211, that is, in the direction of the one side surface of the breathable fabric 10.

The second one side alignment weft 215 is arranged along the same trajectory as the first one side alignment weft 214.

Further, the first other side alignment weft 224 is arranged in contact with the lower side of the first one side warp 111 and the second one side warp 112 and thus fixedly presses the one side warp 110 toward the corresponding first other side weft 221, that is, in the direction of the one side surface of the breathable fabric 10.

Thereafter, the first other side alignment weft 224 is arranged in contact with the upper side of the first other side warp 121 and the second other side warp 122 and thus fixedly presses the other side warp 120 toward the corresponding first other side weft 221, that is, in the direction of the other side surface of the breathable fabric 10.

The second other side alignment weft 225 is arranged along the same trajectory as the first other side alignment weft 224.

In particular, the ventilation hole 20 has an inner edge formed by the second one side alignment warp 115 and the first other side alignment warp 124 adjacent to each other and the second one side alignment weft 215 and the other side alignment warp 124 adjacent to each other.

Meanwhile, the first one side warp 111, the second one side warp 112, the third one side warp 113, the first one side alignment warp 114, and the second one side alignment warp 115 may have the same thickness or different thicknesses [deniers].

Further, the first other side warp 121, the second other side warp 122, the third other side warp 123, the first other side alignment warp 124, and the second other side alignment warp 125 may have the same thickness or different thicknesses [deniers].

Further, the first one side weft 211, the second one side weft 212, the third one side weft 213, the first one side alignment weft 214, and the second one side alignment weft 215 may have the same thickness or different thicknesses [deniers].

In addition, the first other side weft 221, the second other side weft 222, the third other side weft 223, the first other side alignment weft 224, and the second other side alignment weft 225 may have the same thickness or different thicknesses [deniers].

In the present disclosure, it is illustrated that the first one side warp 111, the second one side warp 112, the third one side warp 113, the first other side warp 121, the second other side warp 122, the third other side warp 123, the first one side weft 211, the second one side weft 212, the third one side weft 213, the first other side weft 221, the second other side weft 222, and the third other side weft 223 have the same thickness or similar thicknesses.

Further, it is illustrated that the first one side alignment warp 114, the second one side alignment warp 115, the first other side alignment warp 124, the second other side alignment warp 125, the first one side alignment weft 214, the second one side alignment weft 215, the first other side alignment weft 224, and the second other side alignment weft 225 have smaller thicknesses than the first one side warp 111.

In this case, the first one side alignment warp 114, the second one side alignment warp 115, the first other side alignment warp 124, the second other side alignment warp 125, the first one side alignment weft 214, the second one side alignment weft 215, the first other side alignment weft 224, and the second other side alignment weft 225 may be made of a transparent material or a material having a different color from that of the first one side warp 111 to maximize aesthetics of the breathable fabric 10.

Meanwhile, the first one side warp 111, the second one side warp 112, the third one side warp 113, the first one side alignment warp 114, and the second one side alignment warp 115 may be made of the same material or different materials.

Further, the first other side warp 121, the second other side warp 122, the third other side warp 123, the first other side alignment warp 124, and the second other side alignment warp 125 may be made of the same material or different materials.

Further, the first one side weft 211, the second one side weft 212, the third one side weft 213, the first one side alignment weft 214, and the second one side alignment weft 215 may be made of the same material or different materials.

In addition, the first other side weft 221, the second other side weft 222, the third other side weft 223, the first other side alignment weft 224, and the second other side alignment weft 225 may be made of the same material or different materials.

Of course, various materials and various shape may be applied to the first one side warp 111, the second one side warp 112, the third one side warp 113, the first other side warp 121, the second other side warp 122, the third other side warp 123, the first one side weft 211, the second one side weft 212, the third one side weft 213, the first other side weft 221, the second other side weft 222, and the third other side weft 223.

Likewise, various materials and various shapes may be applied to the first one side alignment warp 114, the second one side alignment warp 115, the first other side alignment warp 124, the second other side alignment warp 125, the first one side alignment weft 214, the second one side alignment weft 215, the first other side alignment weft 224, and the second other side alignment weft 225.

As an example, monofilament yarn may be applied to the first one side alignment warp 114, the second one side alignment warp 115, the first other side alignment warp 124, the second other side alignment warp 125, the first one side alignment weft 214, the second one side alignment weft 215, the first other side alignment weft 224, and the second other side alignment weft 225.

As an example, draw textured yarn (DTY) may be applied to the first one side warp 111, the second one side warp 112, the third one side warp 113, the first other side warp 121, the second other side warp 122, the third other side warp 123, the first one side weft 211, the second one side weft 212, the third one side weft 213, the first other side weft 221, the second other side weft 222, and the third other side weft 223.

In this case, the DTY is processed yarn processed by false-twisting filament yarn and then applying heat to the filament yarn to fix the filament yarn and the processed yarn is bulky and has elasticity and stiffness.

Here, false twisting is a method in which the filament yarn is twisted and is then detwisted, that is, the twisting and the detwisting are simultaneously performed in a false-twist device to provide a crimp.

Further, the monofilament yarn is yarn made of a fiber having an infinite length and is single yarn made of one type of fiber selected from the group consisting of silk fibers such as a natural fiber and a rayon fiber, cupra fibers such as a regenerated fiber, and synthetic fibers such as polyester fibers, polyolefin fibers, polyvinyl alcohol fibers, polyamide fibers, polyurethane fibers, and polyvinylidene chloride fibers.

In particular, when the DTY obtained by processing the filament yarn is not used and raw yarn is used as it is, the raw yarn is not suitable for a role of a rear layer applied to artificial leather due to degradation of elasticity, touch sense, versatility, and high quality, marketability is also degraded, and thus the DTY obtained by processing the filament yarn may be used.

The DTY may be dope dyed yarn or may be dyed by a post-dyeing method.

Further, when a twisting angle θ of the DTY is in a range of 40° to 55° or 45° to 50°, the productivity is excellent.

In addition, a linear mass density D of the DTY may be in a range of 60 to 90 deniers or 70 to 85 deniers. When the linear mass density D is less than this range, the thickness is too low, and thus the strength may decrease. When the linear mass density D is greater than this range, cost increases and the rear layer becomes too heavy, and thus the elongation as artificial leather for interior materials of commercial vehicles may decrease. Thus, the DTY may have a thickness within this range.

Figure 5:
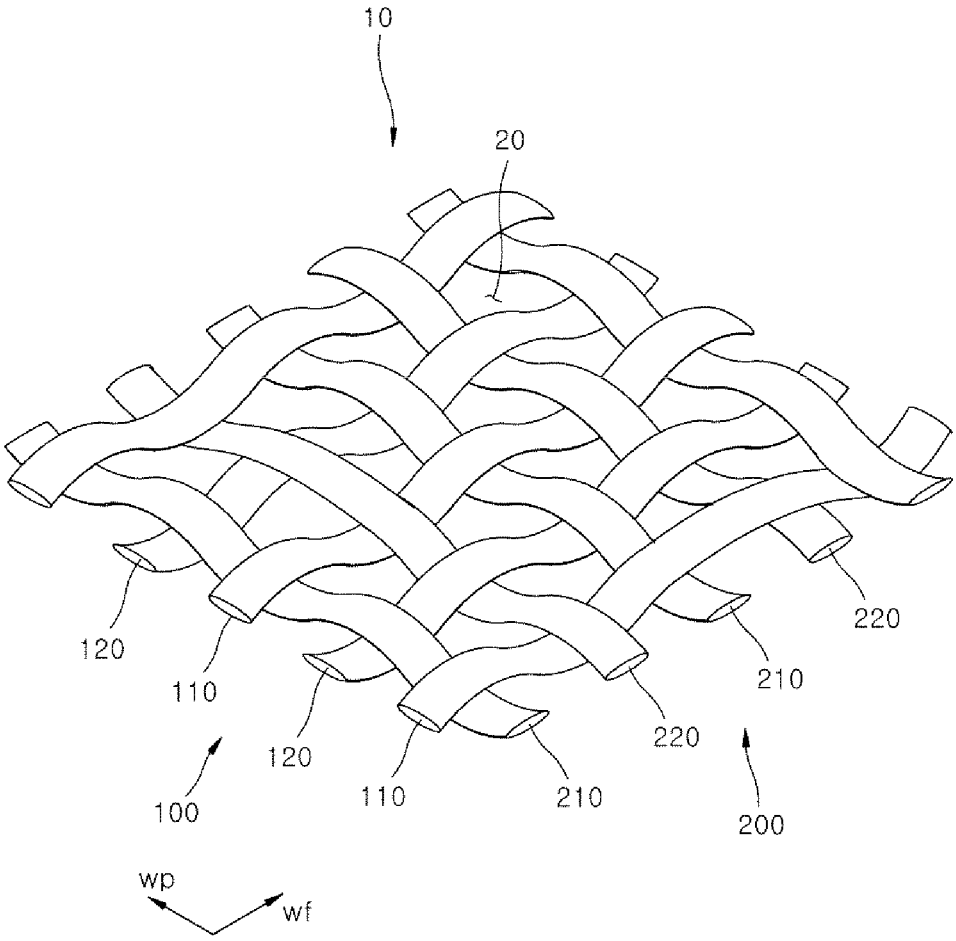
FIG. 5 is an enlarged perspective view of a breathable fabric according to another embodiment of the present disclosure.
Figure 6:
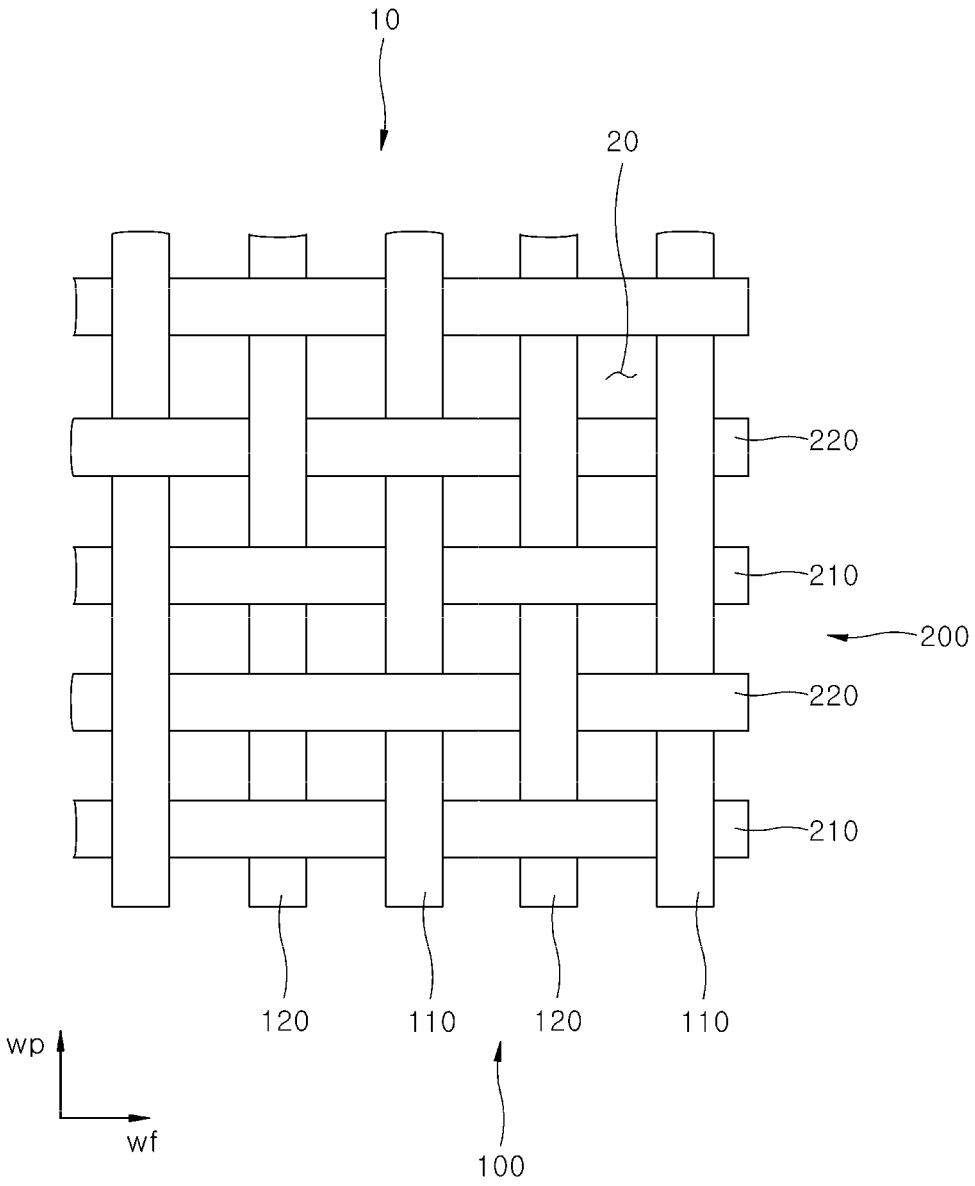
FIG. 6 is a plan view of the breathable fabric according to another embodiment of the present disclosure.

FIG. 5 is an enlarged perspective view of a breathable fabric according to another embodiment of the present disclosure, and FIG. 6 is a plan view of the breathable fabric according to another embodiment of the present disclosure.

Referring to FIGS. 5 and the 6, like the embodiment, a breathable fabric 10 according to another embodiment of the present disclosure is formed by weaving a plurality of strands of a warp wp and 100 and a plurality of strands of a weft wf and 200 in a lattice shape. That is, the warp 100 and the weft 200 are arranged perpendicular or oblique to each other.

In particular, the warp 100 is arranged in a transverse direction while the plurality of strands thereof are spaced apart from each other at regular or irregular intervals, and the weft 200 is arranged in a longitudinal direction while the plurality of strands thereof are spaced apart from each other at regular or irregular intervals.

Further, the breathable fabric 10 is formed by weaving each strand of the warp 100 and each strand of the weft 200 with the plurality of strands of warp 100 and the plurality of strands of weft 200 arranged in directions oblique to each other.

In particular, the warp 100 is arranged over the same upper side or lower side of two or more of the strands of the weft 200 at a specific position, and the weft 200 is arranged over the same upper side or lower side of two or more of the strands of the warp 100 at a set position.

In this case, in the breathable fabric 10, a corresponding position of the warp 100 arranged over the same upper side or lower side of two or more of the strands of the weft 200 and a corresponding position of the weft 200 arranged over the same upper side or lower side of two or more of the strands of the warp 100 may be arranged convexly in directions opposite to each other in the same area or may be arranged convexly in the same direction or the opposite directions in different areas.

In particular, the plurality of strands of the warp 100 are arranged apart from each other at a set interval in the transverse direction, the plurality of strands of the weft 200 are arranged apart from each other at a set interval in the longitudinal direction, the warp 100 and the weft 200 are woven together, and thus the woven breathable fabric 10 forms a ventilation hole 20 having a set size.

In addition, in the warp 100, the one side warp 110 and the other side warp 120 are alternately arranged, and in the weft 200, the one side weft 210 and the other side weft 220 are alternately arranged.

In this case, in one direction, the one side warp 110 and the other side warp 120 are sequentially and alternately arranged. In addition, in the one direction, the one side weft 210 and the other side weft 220 are sequentially and alternately arranged.

Further, the one side warp 110 and the other side weft 220 have the same shape, and the other side warp 120 and the one side weft 210 have the same shape.

In particular, the one side warp 110 and the other side warp 120 are alternately and vertically woven on the corresponding one side weft 210 and the corresponding other side weft 220.

In addition, at least one of the one side warp 110 and the other side warp 120 is arranged over the same upper side or lower side of two or more of the strands of the weft 200 at a specific position. That is, at least one of the one side warp 110 and the other side warp 120 is arranged over the same upper side or lower side as the one side weft 210 and the other side weft 220 adjacent to each other in the longitudinal direction at a specific position.

Likewise, the one side weft 210 and the other side weft 220 are alternately and vertically woven on the corresponding one side warp 110 and the corresponding other side warp 120.

Further, at least one of the one side weft 210 and the other side weft 220 is arranged over the same upper side or lower side of two or more strands of the warp 100 at set positions of two or more strands at a specific position. That is, at least one of the one side weft 210 and the other side weft 220 is arranged over the same upper side or lower side as the one side warp 110 and the other side warp 120 adjacent to each other in the transverse direction at a specific position.

Thus, in the present embodiment, the breathable fabric 10 has a complex pattern such as an area in which the warp 100 and the weft 200 are alternately, continuously, and vertically woven to form a substantially square lattice pattern, an area in which the warp 100 is arranged over the same upper side or lower side of two or more strands of the adjacent weft 200 to form a pattern that increases a three-dimensional effect, and an area in which the weft 200 is arranged over the same upper side or lower side of two or more strands of the adjacent warp 100 to form a pattern that increases a three-dimensional effect. Thus, the breathable fabric 10 improves the aesthetics and the three-dimensional effect.

In particular, the ventilation hole 20 may be formed by at least one of the area in which the warp 100 is arranged over the same upper side or lower side of two or more strands of the adjacent weft 200 to form a pattern that increases a three-dimensional effect, the area in which the weft 200 is arranged over the same upper side or lower side of two or more strands of the adjacent warp 100 to form a pattern that increases a three-dimensional effect, an area in which the one side warp 110 and the other side warp 120 are woven to be spaced a predetermined distance from each other in the transverse direction, and an area in which the one side weft 210 and the other side weft 220 are woven to be spaced a predetermined distance from each other in the transverse direction.

Meanwhile, the first one side warp 111, the second one side warp 112, the one side weft 210, and the other side weft 220 may be made of the same material or different materials and may have the same linear mass density or different linear mass densities.

In this case, each of the first one side warp 111, the second one side warp 112, the one side weft 210, and the other side weft 220 may be provided as the plurality of strands that are the same as in the above-described embodiment and may be woven in the same pattern as in the embodiment.

As described above, unlike the related art, in a breathable fabric according to the present disclosure, the weft and warp of the fabric are each provided as a plurality of strands of yarn, some of the plurality of strands of yarn constituting the weft are convexly woven on one side of the fabric and the others are convexly woven on the other side of the fabric, some of the plurality of strands of yarn constituting the warp are convexly woven on other side of the fabric and the others are convexly woven on the one side of the fabric, and thus the fabric can be woven to have a three-dimensional effect in a desired shape, thereby implementing excellent aesthetics.

The present disclosure may be utilized as a fabric requiring breathability by weaving the weft and the warp in a lattice shape to form a ventilation hole.

According to the present disclosure, as alignment yarn is woven on outermost sides of each of the weft and the warp provided as a plurality of strands of yarn, a state in which the strands of the weft and the strands of the weft are bundled is maintained, and thus the durability of the fabric can increase and the shape of the ventilation hole can be maintained.

According to the present disclosure, as the warp and the weft are woven in a predetermined pattern so that the ventilation hole is formed at a set position of the fabric, no post-processing is required, and thereby productivity is improved and environmental pollution is reduced.

Although the present disclosure has been described with reference to embodiments illustrated in the drawings, the description is merely illustrative, and those skilled in the art to which the technology belongs should understand that various modifications and other equivalent embodiments may be made. Thus, the true technical scope of the present disclosure should be determined according to the appended claims.

What is claimed is:

1. A breathable fabric comprising:

a warp (wp) of which a plurality of strands are spaced a uniform or non-uniform distance from each other and arranged in a transverse direction; and a weft (wf) of which a plurality of strands are spaced a uniform or non-uniform distance from each other, are arranged in a longitudinal direction, and are woven in an inclined direction with respect to the warp to form a lattice shape, wherein the warp is woven to alternately and vertically cross one strand of the weft and is arranged over the same upper side or lower side of two or more strands of the weft at a specific position, and the weft is arranged over the same upper side or lower side of two or more strands of the warp at a set position, wherein, in the warp, a one side warp and an other side warp are alternately arranged, and in the weft, a one side weft and an other side weft are alternately arranged, the one side warp includes a first one side warp and a second one side warp, the other side warp includes a first other side warp and a second other side warp, the one side weft includes a first one side weft and a second one side weft, the other side weft includes a first other side weft and a second other side weft, and at least one of the first one side warp and the second one side warp is arranged above the first one side weft and the second one side weft and below the first other side weft and the second other side weft in an area in which one strand of the warp and one strand of the weft vertically cross each other, wherein the one side warp includes a third one side warp disposed between the first one side warp and the second one side warp, the one side weft includes a third one side weft disposed between the first one side weft and the second one side weft, the other side weft includes a third other side weft disposed between the first other side weft and the second other side weft, the first one side warp and the second one side warp are arranged above the third one side weft and arranged below the third other side weft, and the third one side warp is disposed above the first one side weft and the second one side weft, disposed below the third one side weft, and disposed above the third other side weft.

2. The breathable fabric of claim 1, wherein the other side warp includes a third other side warp disposed between the first other side warp and the second other side warp, the first other side warp and the second other side warp are arranged below the first one side weft, the second one side weft, and the third one side weft and arranged above the first other side weft, the second other side weft, and the third other side weft, and the third other side warp is disposed below the first one side weft, the second one side weft, and the third other side weft and is disposed above the third one side weft, the first other side weft, and the second other side weft.

3. A breathable fabric comprising:

a warp (wp) of which a plurality of strands are spaced a uniform or non-uniform distance from each other and arranged in a transverse direction; and a weft (wf) of which a plurality of strands are spaced a uniform or non-uniform distance from each other, are arranged in a longitudinal direction, and are woven in an inclined direction with respect to the warp to form a lattice shape, wherein the warp is woven to alternately and vertically cross one strand of the weft and is arranged over the same upper side or lower side of two or more strands of the weft at a specific position, and the weft is arranged over the same upper side or lower side of two or more strands of the warp at a set position, wherein, in the warp, a one side warp and an other side warp are alternately arranged, and in the weft, a one side weft and an other side weft are alternately arranged, the one side warp includes a first one side warp and a second one side warp, the other side warp includes a first other side warp and a second other side warp, the one side weft includes a first one side weft and a second one side weft, the other side weft includes a first other side weft and a second other side weft, and at least one of the first one side warp and the second one side warp is arranged above the first one side weft and the second one side weft and below the first other side weft and the second other side weft in an area in which one strand of the warp and one strand of the weft vertically cross each other, wherein the one side warp includes a first one side alignment warp disposed along an outside of the first one side warp and a second one side alignment warp disposed along an outside of the second one side warp, the other side warp includes a first other side alignment warp disposed along an outside of the first other side warp and a second other side alignment warp disposed along an outside of the second other side warp, the first one side alignment warp and the second one side alignment warp are symmetrical to the first one side warp, arranged below the one side weft, and arranged above the other side weft, and thus guide the one side weft and the other side weft such that the one side weft and the other side weft are in close contact with the first one side warp, and the first other side alignment warp and the second other side alignment warp are symmetrical to the first other side warp, arranged above the one side weft, and arranged below the other side weft, and thus guide the one side weft and the other side weft such that the one side weft and the other side weft are in close contact with the first other side warp.

4. The breathable fabric of claim 1, wherein a plurality of threads of yarn constituting the warp have the same linear mass density or different linear mass densities, and a plurality of threads of yarn constituting the weft have the same linear mass density or different linear mass densities.

5. The breathable fabric of claim 4, wherein the plurality of threads of yarn constituting the warp are made of the same material or different materials, and the plurality of threads of yarn constituting the weft are made of the same material or different materials.

6. The breathable fabric of claim 3, wherein a plurality of threads of yarn constituting the warp have the same linear mass density or different linear mass densities, and a plurality of threads of yarn constituting the weft have the same linear mass density or different linear mass densities.

7. The breathable fabric of claim 6, wherein the plurality of threads of yarn constituting the warp are made of the same material or different materials, and the plurality of threads of yarn constituting the weft are made of the same material or different materials.

* * * * *